US005125251A

United States Patent [19]

Pettersson et al.

[11] Patent Number: 5,125,251

[45] Date of Patent: Jun. 30, 1992

[54] METHOD AND APPARATUS TO REDUCE THE OUTER DIAMETER AND WALL THICKNESS OF A HOLLOW TUBE BLANK BY ROLLING

[75] Inventors: Gustav-Adolf Pettersson; Ernst Zimmert; Bengt Jagaeus; Aake Sandberg, all of Hofors, Sweden

[73] Assignee: Mannesmann AG, Dusseldorf, Fed. Rep. of Germany

[21] Appl. No.: 646,769

[22] Filed: Jan. 7, 1991

[30] Foreign Application Priority Data

Jul. 5, 1988 [DE] Fed. Rep. of Germany ..... 3823135

[51] Int. Cl.[5] ..... B21B 19/06

[52] U.S. Cl. ..... 72/15; 72/96

[58] Field of Search ..... 72/14, 15, 68, 96, 100

[56] References Cited

U.S. PATENT DOCUMENTS

| | | | |
|---|---|---|---|
| 1,983,934 | 12/1934 | Devine | 80/62 |
| 2,556,120 | 6/1951 | Sutton | 72/100 |
| 4,275,578 | 6/1981 | Steinbrecher et al. | 72/14 |

FOREIGN PATENT DOCUMENTS

| | | | |
|---|---|---|---|
| 803230 | 1/1951 | Fed. Rep. of Germany . | |
| 3215389 | 10/1983 | Fed. Rep. of Germany | 72/68 |
| 1096090 | 6/1955 | France . | |
| 50-15232 | 3/1975 | Japan . | |
| 56-144809 | 11/1981 | Japan . | |
| 57-41837 | 3/1982 | Japan . | |
| 57-134204 | 8/1982 | Japan . | |
| 59-92108 | 5/1984 | Japan . | |
| 61-74713 | 4/1986 | Japan . | |

*Primary Examiner*—Lowell A. Larson
*Attorney, Agent, or Firm*—Nils H. Ljungman & Associates

[57] ABSTRACT

In a process for reducing the outer diameter and wall thickness of an essentially cylindrical hollow tube blank by rolling, the front end of the tube blank is introduced into a rolling mill. To prevent piping defects during rolling and to obviate other disadvantages of conventional processes, the diameter and/or the wall thickness of the trailing end portion of the tube blank is reduced before the trailing end portion is introduced into the reduction zone of the rolling mill.

18 Claims, 6 Drawing Sheets

METHOD AND APPARATUS TO REDUCE THE OUTER DIAMETER AND WALL THICKNESS OF A HOLLOW TUBE BLANK BY ROLLING

CROSS REFERENCE TO RELATED APPLICATIONS

This application is a continuation-in-part of co-pending International Application No. PCT/DE89/00407 filed on Jun. 16, 1989, entitled "Method And Arrangement For Reducing The Outer Diameter And Wall Thickness Of An Essentially Cylindrical Hollow Rough-Pierced Tube Blank By Rolling", which claims priority from Federal Republic of Germany Patent Application No. P 38 23 135.2, filed on Jul. 5, 1988.

BACKGROUND OF THE INVENTION

1. Field of the Invention

The present invention relates to a process to reduce, by rolling, the outer diameter and the wall thickness of a generally cylindrical, hollow tube blank, and more particularly, to a tube forming process wherein an end portion of the hollow blank is reduced in size to compensate for the increase in size which occurs to the end portion of the tubing during the next rolling stage.

2. Background Information

During hot rolling of a steel tube, the diameter and the wall thickness of a hollow tube blank are reduced at a temperature of approximately 1,000 degrees C. This reduction is performed in a rolling mill by rolls that are, preferably, positioned symmetrically around the axis of the tube. An internal mandrel is introduced into the tube blank to support the tube during rolling. During rolling, material from the tube blank flows primarily in a longitudinal direction toward the unrolled portion of the tube blank. Because of the reduction forces generated during rolling and the geometry of the rolls and the tube blank, the tube blank has a tendency to expand in a direction transverse to the longitudinal axis thereof when the blank enters the reduction zone.

The degree of expansion of the tube blank is determined, in part, by the wall thickness of the tube blank. The thicker the wall, the greater the transverse expansion. When rolling the trailing end portion of thin-walled tubes, wherein the ratio of outer diameter to wall thickness is approximately 35:1, the expansion of the tube in the transverse direction and the resulting enlargement of the tube diameter is so great that the rolls slide against the tube, and the tube becomes jammed. Consequently, the rolling operation produces a residual funnel-shaped triangular end portion on the tube at the trailing end of the tube.

One way to alleviate this problem is to cut off the funnel-shaped portion of the tube before it enters the rolling mill. However, this operation reduces the efficiency of the rolling mill process. Overall funneling of the tube trailing end portion creates many problems. In particular, the presence of a funnel at the tube end portion prevents the production of thin-walled tubes having the desired wall thicknesses. Also, due to the formation of the funnel on the tube end the tube may become lodged or stuck in the rolling roll, and to remove the tube is a time-consuming and expensive disassembly process. As a result of the required disassembly process, the subsequent tubes in the line must then also be scrapped because the tubes cool in temperature to the extent that they cannot be used in subsequent process steps. The funnel also exerts great stresses on the rolls and operating parts. The stresses are known to reach a magnitude where the rolls tear and couplings and transmissions break. An additional disadvantage is that it becomes difficult to take measurements at the trailing end portion of the tubes.

OBJECT OF THE INVENTION

An object of the present invention is to avoid the formation of a funnel-shaped portion on a tube during rolling of the tube, to eliminate the above-mentioned disadvantages and achieve higher productivity.

SUMMARY OF THE INVENTION

This object is achieved by the present invention wherein the trailing end portion of the tube blank is pre-reduced such as by rolling, plastic working, forging, machining or turning before the trailing end portion enters the roll gap of the rolling mill.

DESCRIPTION OF THE PREFERRED EMBODIMENTS

Figure 1:
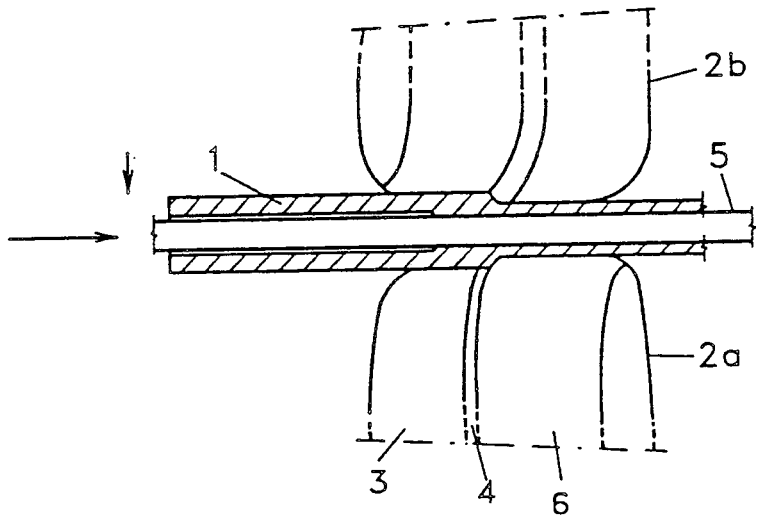
FIG. 1 is a fragmentary, schematic, side elevational view, partially in section, of the hot rolling of a tube in an Assel rolling mill.
Figure 1A:
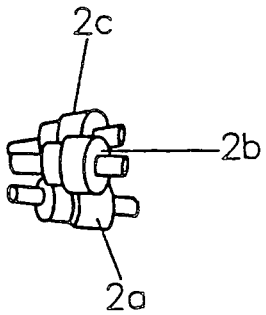
FIG. 1A is a schematic side elevational view of an Assel rolling mill, illustrating the relative positioning of the rolls.

Referring to FIG. 1, there is illustrated the hot rolling of tube stock, such as, a tube blank 1, which normally proceeds in a known Assel rolling mill, shown in FIG. 1A. U.S. Pat. No. 4,444,035 discloses a three-roll Assel mill and is incorporated herein by reference for a disclosure of the features thereof. Other examples of rolling mills and apparatus for forming hollow tube stock or pipe are disclosed in U.S. Pat. Nos. 4,809,423; 4,776,194; 4,706,488: 4,472,958; 4,387,584; 4,319,406: 4,289,011, 4,260,096 4,222,255: 4,184,352: 3,977,410; and 1,983,934, which are also incorporated herein by reference for the features of known rolling mills and the like. As shown in FIG. 1, an extended mandrel 5 is first introduced into a hollow tube or tube blank 1 which has been heated to approximately 1,000° C. The leading end of tube blank 1 with the mandrel 5 therein is first introduced in the direction indicated by the arrow in FIG. 1 into the pulling-in portion 3 between rolls 2*a*, 2*b* and 2*c* of the rolling mill, shown in FIG. 1A. The tube 1 is then moved onto shoulders of the Assel rolling mill. The reduction of the tube 1 takes place in a reduction zone at shoulder 4 of the rolling mill. FIG. 1 illustrates reduction of the tube blank 1 as the leading end portion is being fed through the rolling mill. The reduced tube 1 is then moved through a finishing portion 6 of the rolling mill, where the tube is given its final shape.

Figure 2:
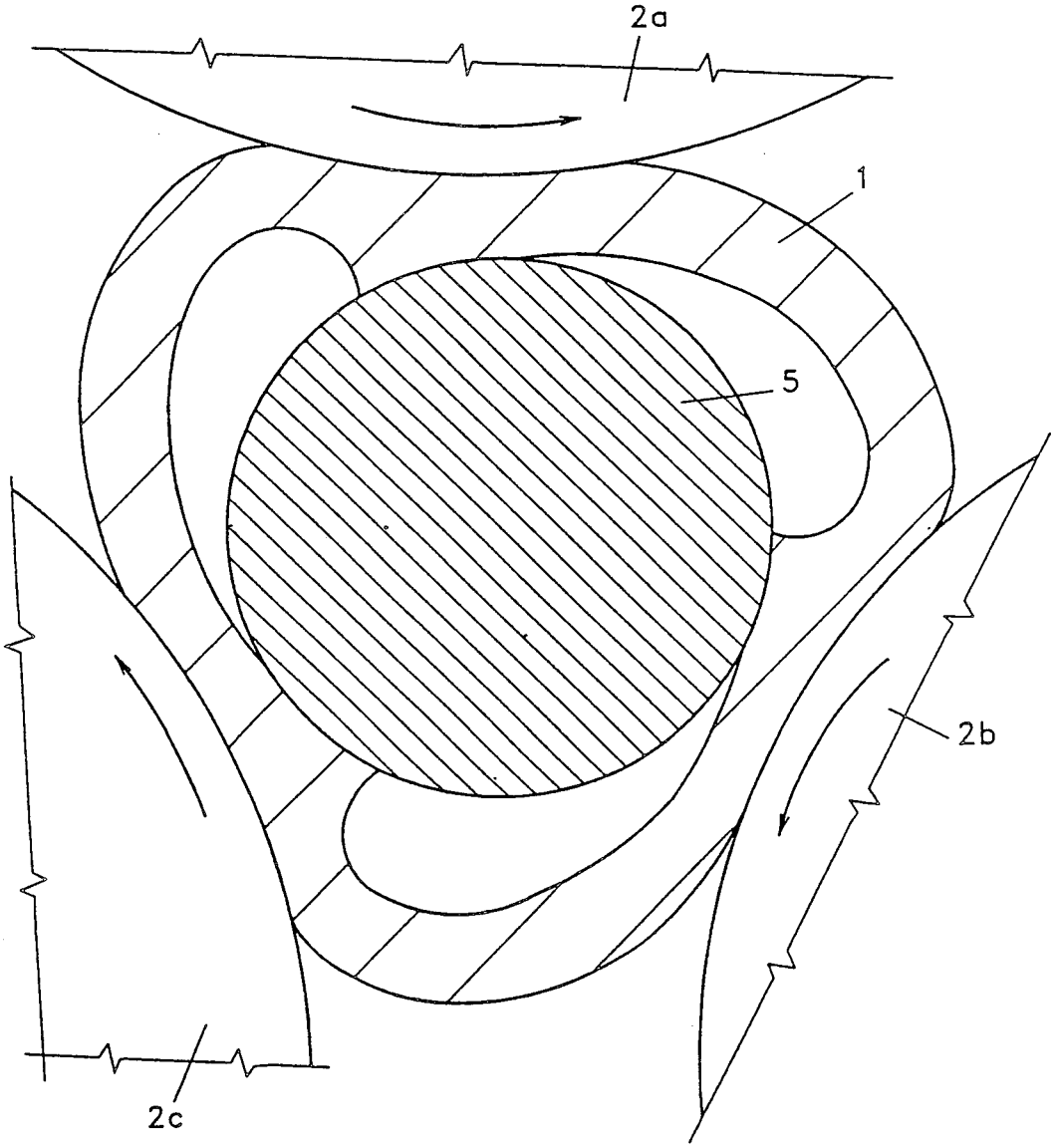
FIG. 2 is a schematic rear elevational view, partially in section, of a tube being rolled in an Assel rolling mill, illustrating the looping of the tube that occurs during rolling of the tube.

On account of the friction between the rolls *2a, 2b* and *2c* and the tube 1, the tube rotates. Also, on account of the diagonal positioning of the rolls *2a, 2b* and *2c*, as shown in FIG. 1A, a thrust is simultaneously exerted in the direction of rolling. When thin-walled tubes are rolled, a relatively large spread of material transverse to the rolling direction in the tube blank 1 occurs, as shown in FIG. 2. The direction of rotation of the rolls *2a, 2b* and *2c* is indicated by the arrows shown in FIG. 2. Consequently, a triangular-shaped "loop" is formed in the tube 1 in the rolling mill reduction zone, as shown in FIG. 2.

The looping of the tube material is counteracted or supported by the unreduced material of the tube 1 approaching the rolling mill. At the trailing or rear end portion of the tube blank 1, where the quantity of tube material is low, particularly for thin-walled tubes, this counteracting or supporting effect is diminished. Consequently, the loop formed in the tube material can become quite long. The trailing end portion of the the tube 1 advancing through the rolling mill spreads out into a primarily funnel or triangular shape. When funneling of the tube 1 occurs, the tube gets lodged or stuck in the rolling mill or slipping occurs during the thrust between the rolls *2a, 2b* and *2c* and the tube 1.

To eliminate the occurrence of the above described funnel or triangular-shaped formation on tube 1 during the rolling operation, the diameter and/or the wall thickness of the trailing end portion of the tube 1 are reduced before the trailing end portion of the tube 1 is introduced into the reduction zone at the shoulders 4 of the rolling mill, shown in FIG. 1. The pre-reduction of the tube trailing end can be performed at any time during the rolling process, but before introduction of the trailing end of the tube 1 into the Assel rolling mill.

Figure 4:
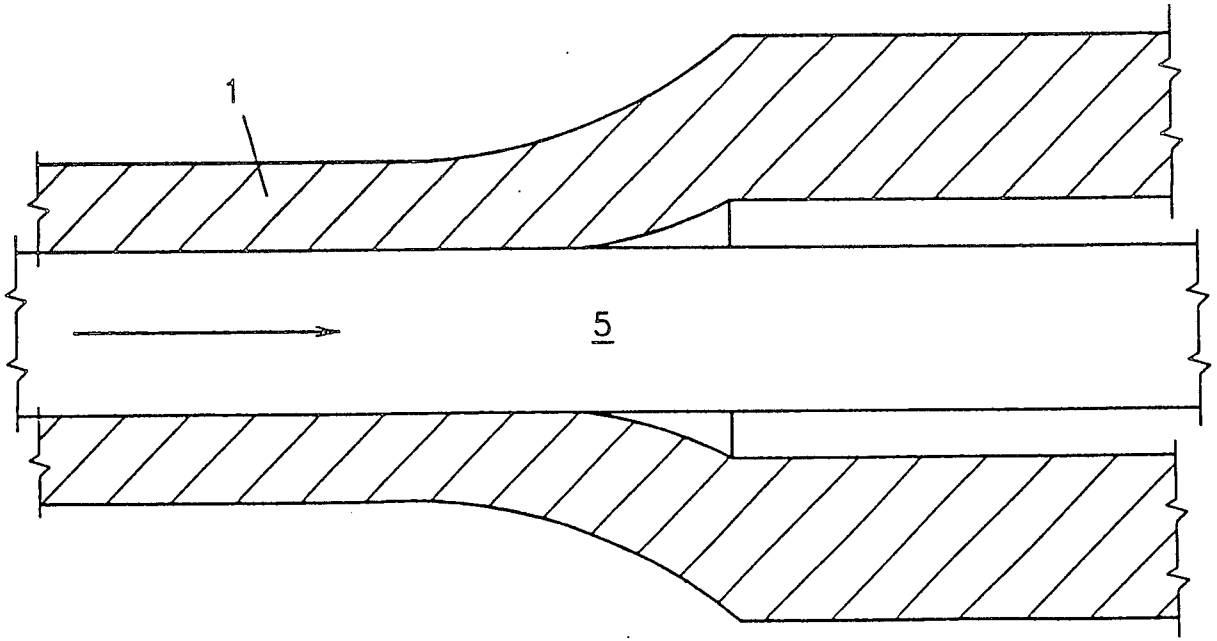
FIG. 4 is a fragmentary, sectional view in side elevation of a tube blank trailing end portion formed in accordance with the present invention.

The pre-reduction of the trailing end portion of the tube 1 is performed by any suitable and desired method, for example, by plastic working methods including forging or rolling, or by machining operations including turning. A plastic working pre-reduction performed on-line in the roll milling process.is particularly advantageous because it may be performed in a single heat. FIG. 4 illustrates a tube 1 positioned on the mandrel 5 where the trailing end portion has been pre-reduced so that the outer diameter of the tube at the trailing end portion is less that the outer diameter of the portion of the tube that precedes the trailing end portion in the rolling mill reduction zone, shown in FIG. 1.

Figure 3:
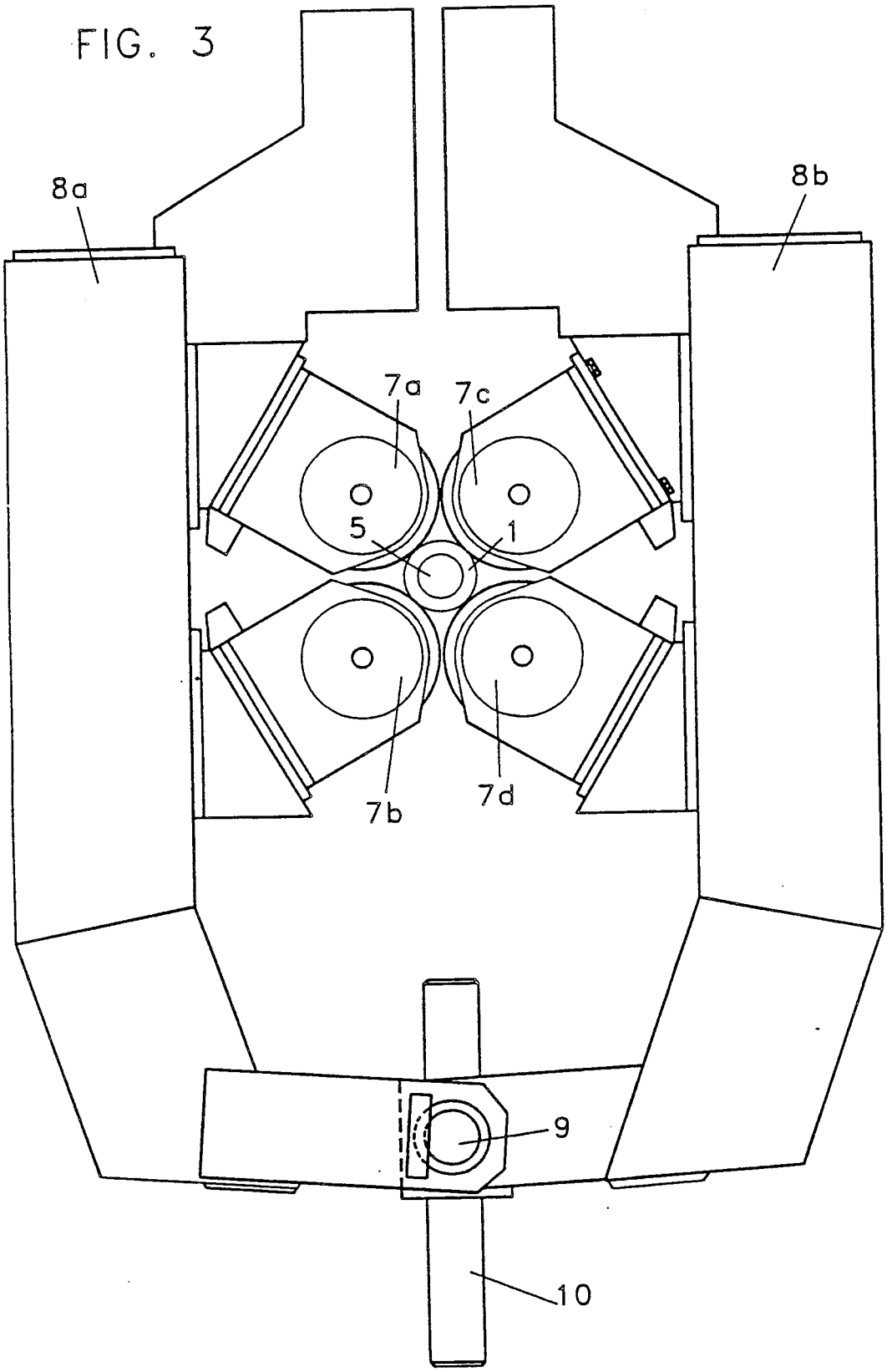
FIG. 3 is a schematic elevational view of an on-line pre-reduction machine for reducing a trailing end portion of the tube prior to introduction of the tube trailing end portion in an Assel mill.

Now referring to FIG. 3, there is shown a pre-reduction apparatus for achieving the desired on-line pre-reduction of the tube blank 1. The pre-reduction apparatus includes four pre-reduction rolls *7a, 7b, 7c* and *7d*. The rolls are arranged in a self-centering or symmetrical configuration around the tube blank 1, adjacent the Assel rolling mill, shown in FIGS. 1 and 1A. Pre-reduction rolls *7a, 7b, 7c* and *7d* are arranged in pairs on arms *8a* and *8b*. Arms *8a* and *8b* can rotate about a pivotal axis of a hinge 9. The hinge 9 is positioned in underlying relation with the tube blank 1 and the rolls *7a, 7b, 7c* and *7d*. The arms *8a* and *8b* can be pressed against or moved toward one another by a power transmission apparatus. In one embodiment, a hydraulic cylinder moves arms *8a* and *8b* to move the rolls *7a, 7b, 7c* and *7d* toward one another into contact with the tube 1.

In normal operation, prior to the pre-reduction operation, the tube blank 1 passes freely through the pre-reduction rolls *7a, 7b, 7c* and *7d*. However when the trailing end portion of the tube blank 1 approaches the pre-reduction rolls, the power transmission apparatus is actuated to move the arms *8a* and *8b* to, in turn, move the rolls into engagement with the tube blank 1. The tube blank 1 continues its direction of feed through the rolling mill, as shown in FIG. 1, as the wall thickness and the diameter of the trailing end portion are reduced. FIG. 4 illustrates the resultant configuration of the tube trailing end portion following the pre-reduction operation.

The power transmission apparatus can be manually activated. Preferably, the pre-reduction rolling mill apparatus includes a sensing apparatus, diagrammatically illustrated in FIG. 5. As will be explained later in greater detail, the sensing apparatus senses the passage of the tube blank trailing end portion into the vicinity of the pre-reduction apparatus, shown in FIG. 3. The proximity of the tube trailing end to the pre-reduction apparatus is sensed a preselected distance from the pre-reduction apparatus. The sensing apparatus, upon detection of the tube trailing end, transmits a signal which initiates actuation of pivotal movement of arms *8a* and *8b* to move rolls *7a, 7b, 7c* and *7d* into compressive relation with the tube tailing end portion.

The hinge 9, shown in FIG. 3, is located on a pivot 10, which can be installed in a corresponding hole in the frame of the Assel rolling mill. In this manner, the pre-reduction apparatus is fixed to the stand or frame of the rolling mill, avoiding the construction of a special and expensive stand for the reduction rolls.

While the embodiment of the above described pre-reduction apparatus relates to the hot rolling of tubes in an Assel rolling mill, the described pre-reduction of tube stock can also be used on other types of rolling mills where similar problems occur.

Figure 3A:
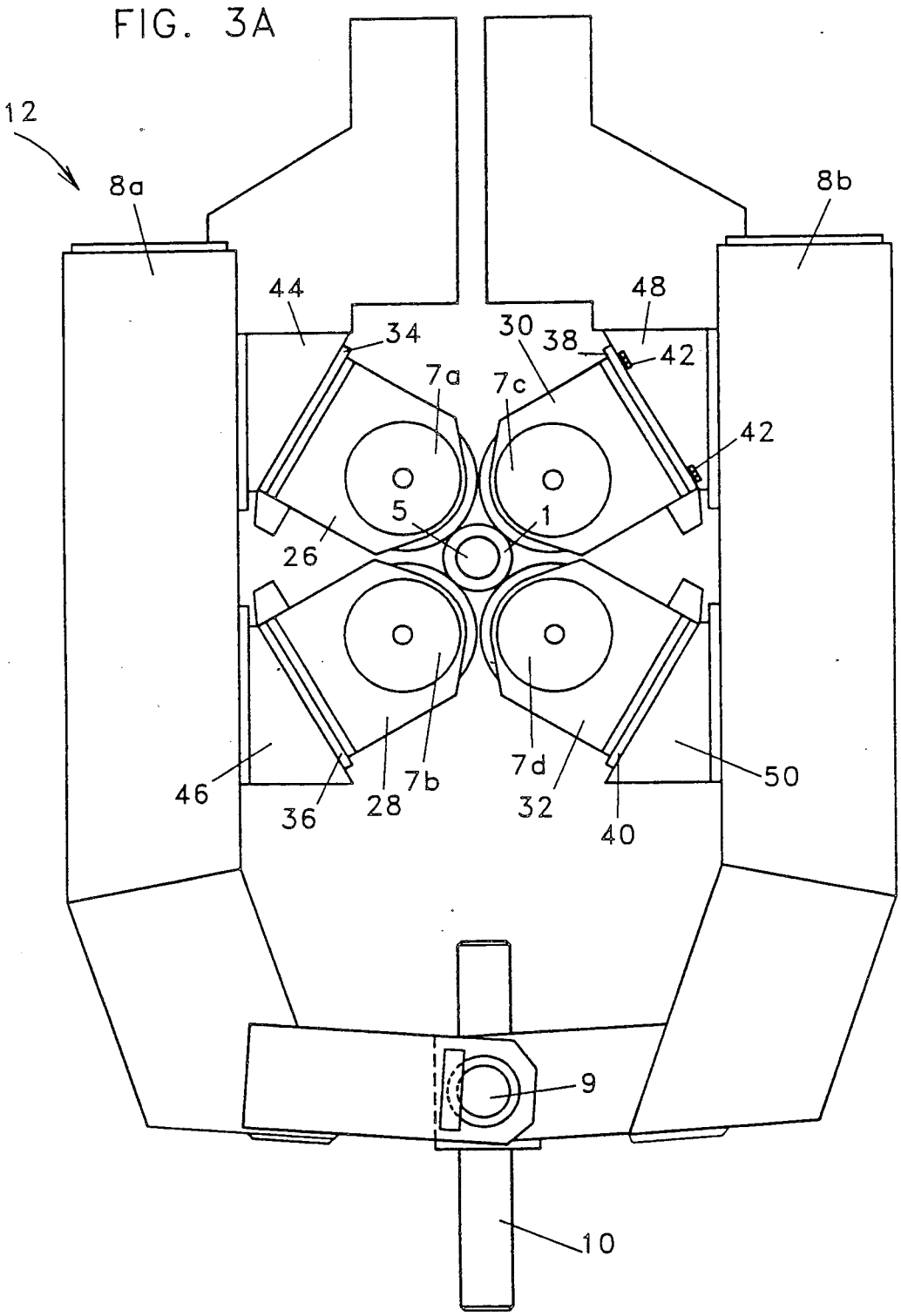
FIG. 3A is a schematic view similar to FIG. 3, further illustrating the on-line pre-reduction machine of the present invention.
Figure 5:
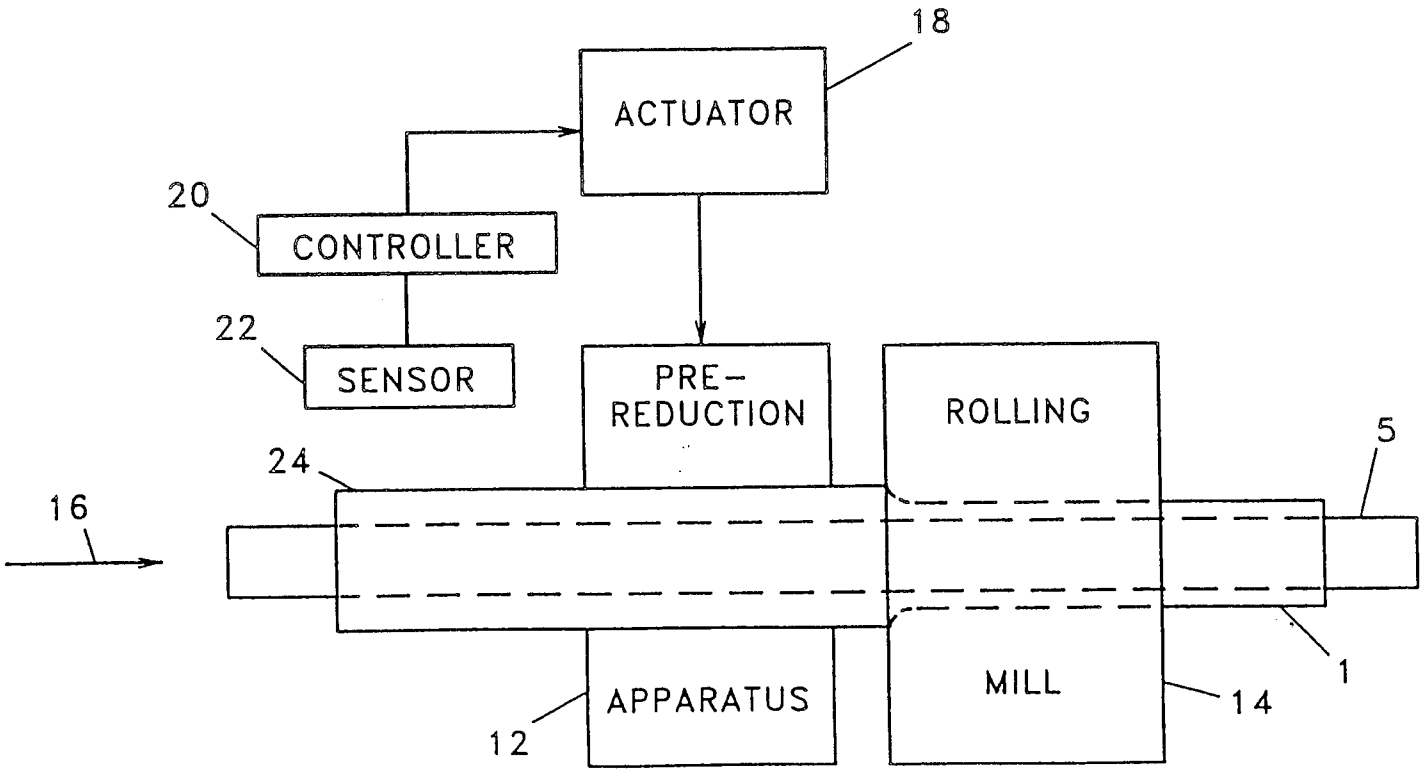
FIG. 5 is a diagrammatic view of apparatus for controlling the on-line pre-reduction machine shown in FIGS. 3 and 3A.

Now referring to FIG. 5, there is illustrated pre-reduction apparatus 12 in accordance with the present invention, corresponding to the pre-reduction apparatus described above and illustrated in FIG. 3 and further illustrated in FIG. 3A. The apparatus 12 is positioned adjacent rolling mill 14 and preferably is fixed thereto, as also discribed above. The apparatus 12 is positioned upstream or in advance of the rolling mill 14 for the direction of feed indicated by the arrow 16 in FIG. 5. For the embodiment of the apparatus 12, shown in FIGS. 3 and 3A, the movable arms are actuated by an actuator 18. A suitable actuator 18 for use in the present invention is one or more pneumatic or hydraulic cylinders connected to the movable arms. A linear displacement motor is another example of a suitable actuator 18 for generating the required movement of the arms.

The actuator 18 is energized by a controller 20 which is suitably connected to the actuator 18. For example, the controller 20 is operable to control the flow of air or fluid to the cylinder or cylinders to initiate movement of the pre-reduction rolls into contact with tube in apparatus 12. A motor is similarly actuated to move the arms and the pre-reduction rolls.

The controller 20 receives signals from a sensor 22 positioned in close proximity to the path of feed of the tube 1 through the pre-reduction apparatus 12. The sensor 22 is a proximity detector operable to identify trailing end portion 24 of tube 1 prior to introduction of the trailing end portion 24 into the pre-reduction apparatus 12. The sensor 22, being conventional in construction, in one embodiment, is electrically operable and includes a microprocessor operable to detect when the trailing end portion 24 passes in close proximity to sensor 22.

An example of a position sensor with a microprocessor suitable for use in position detecting for a rolling mill is disclosed in U.S. Pat. No. 4,776,194, which is incorporated herein by reference. U.S. Pat. No. 4,562,713 also discloses a position detector associated with rolling mechanisms. It should be understood that other types of sensors can be used with the present invention, such as, optical sensors, heat sensors and the like.

Upon detection of the trailing end portion 24 of tube 1 passing in the vicinity of sensor 22, the sensor 22 generates a suitable signal, electrical, optical, or the like to activate the controller 20 to initiate operation of the actuator 18 at the prescribed time, based on the rate of feed of the tube 1, to activate the pre-reduction apparatus 12. For the pre-reduction apparatus 12 shown in FIG. 3A, the activator 13 for example in the form of hydraulic cylinders, is connected to the arms 8*a* and 8*b*. Initially, the rolls 7*a*, 7*b*, 7*c* and 7*d* are removed from contact with the tube 1. The arms 8*a* and 8*b* are urged by operation of the hydraulic cylinders of actuator 18 to move at hinge 9 about the pivot 10 toward the tube 1.

The rolls 7*a*, 7*b*, 7*c* and 7*d* are rotatably supported by journals 26, 28, 30 and 32 positioned on brackets 34, 36, 38 and 40. The brackets 34–40 are suitably connected, as by bolts 42, to flanges 44, 46, 48 and 50, which are formed integral with the respective pair of arms 8*a* and 8*b*. With this arrangement, pivotal movement of arms 8*a* and 8*b* about hinge 9 moves the rolls 7*a*, 7*b*, 7*c* and 7*d* into and out of engagement with the trailing end of tube 1. At the preselected time the actuator 18 is energized to move the arms 8*a* and 8*b* so that rolls 7*a*, 7*b*, 7*c* and 7*d* engage the tube trailing end to reduce the outer diameter of the tube trailing end prior to feeding the trailing end into the rolling mill.

In summary, one feature of the present invention resides broadly in a process for reducing by rolling the outer diameter and wall thickness of a primarily cylindrical hollow tube blank, which is introduced with its leading end portion into a rolling mill, characterized by the fact that the diameter and/or the wall thickness of the trailing end portion of the tube blank is reduced before the trailing end portion enters the reduction zone of the rolling mill.

Another feature of the present invention resides broadly in a process which is characterized by the fact that the tube trailing end portion is pre-reduced by means of plastic working.

Yet another feature of the present invention resides broadly in a process which is characterized by the fact that the tube trailing end portion is pre-reduced by means of rolling.

A further feature of the present invention resides broadly in a process which is characterized by the fact that the trailing end portion is pre-reduced by means of forging.

Another feature of the present invention resides broadly in a process which is characterized by the fact that the trailing end portion is pre-reduced by means of machining.

A further feature of the present invention resides broadly in a process which is characterized by the fact that the trailing end portion of a tube blank is pre-reduced by means of turning.

An additional feature of the present invention resides broadly in a hollow tube blank having a primarily cylindrical shape, the outer diameter and wall thickness of which are reduced in a rolling mill, characterized by the fact that the trailing end of the tube blank 1 has a smaller outer diameter and/or a lower wall thickness than the rest of the primarily cylindrical tube blank.

An additional feature of the present invention resides broadly in a layout for the production of a pre-reduced end portion of a hollow tube blank, the purpose of which is to achieve a reduced outer diameter and a reduced wall thickness during rolling in a rolling mill, characterized by the fact that seen in the entry direction, pre-reduction rolls 7*a*, 7*b*, 7*c* and 7*d* are positioned on-line and ahead of the rolling mill in the feed direction and can be moved toward and away from the tube blank.

A further additional feature of the present invention resides broadly in a layout which is characterized by the fact that the rolls 7*a*, 7*b*, 7*c* and 7*d* are arranged symmetrically around the tube blank 1, namely on two arms 8*a* and 8*b*, which can be moved toward the tube blank by means of a power transmission apparatus.

A further additional feature of the present invention resides broadly in a layout which is characterized by the fact that the arms 8*a* and 8*b* are mounted in a hinge so that they can rotate.

Another further feature of the present invention resides broadly in a layout which is characterized by the fact that the power transmission apparatus includes a hydraulic cylinder for moving the arms 8*a* and 8*b* toward and away from the tube blank.

Another additional feature of the present invention resides broadly in pre-reduction apparatus for a rolling mill that includes sensing mechanism which senses the passage of the tube trailing end portion and transmits a signal which initiates movement of pre-reduction rolls 7*a*, 7*b*, 7*c* and 7*d* into contact with the tube blank 1.

Another feature of the present invention resides broadly in a rolling mill having a tube pre-reduction apparatus fixed to the rolling stand.

All, or substantially all, of components and methods of the various embodiments may be used with at least one embodiment or all of the embodiments, if any, described herein.

All of the patents, patent applications, and publications recited herein, if any, are hereby incorporated by reference as if set forth in their entirety herein.

The details in the patents, patent applications, and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. Process for reducing by rolling the outside diameter and wall thickness of a primarily cylindrical hollow tube blank, comprising the steps of:

introducing a forward end portion of a tube blank into a rolling mill;

providing a mandrel for supporting at least a portion of the tube blank;

feeding the tube blank through the rolling mill to reduce the outside diameter of the tube blank;

reducing the outside diameter of the trailing end portion of the tube blank, while the trailing end portion of the tube blank is being supported by the mandrel, in advance of the rolling mill as the tube blank is fed through the rolling mill; and the rolling mill being a skew rolling mill.

2. Process according to claim 1, which includes:

plastic working the trailing end portion of the tube blank to pre-reduce the outside diameter of the tube blank trailing end portion.

3. Process according to claim 1, which includes:

rolling the trailing end portion of the tube blank to pre-reduce the outside diameter of the tube blank trailing end portion.

4. Process according to claim 1, which includes:

detecting the presence of the trailing end portion of the tube blank in advance of the rolling mill; and initiating the step of reducing the outside diameter of the trailing end portion of the tube blank upon detection of the trailing end portion.

5. Apparatus for the production of a pre-reduced end portion of a hollow tube blank to achieve a reduced outside diameter and a reduced wall thickness during rolling in a rolling mill, said apparatus comprising:

a rolling mill for receiving a hollow tube blank to reduce the outer diameter and wall thickness of the tube blank;

a mandrel for supporting at least a portion of the tube blank;

means for continuously feeding the tube blank through said rolling mill from a leading end portion of the tube blank to a trailing end portion of the tube blank;

pre-reduction means positioned in advance alignment of said rolling mill for reducing the outside diameter of the tube blank trailing end portion, while the tube blank trailing end portion is being supported by the mandrel, prior to introduction of the trailing end portion into said rolling mill as the tube blank passes through the rolling mill; and the rolling mill being a skew rolling mill.

6. Apparatus according to claim 5, wherein:

said pre-reduction means includes a plurality of forming rolls arranged symmetrically around the tube blank;

arm means for supporting said forming rolls for movement into and out of contact with the trailing end portion of the tube blank; and power transmission means for moving said arm means for engagement of said forming rolls with the tube blank trailing end portion to reduce the outside diameter of the tube blank at the trailing end portion as the tube blank is fed through said rolling mill.

7. Apparatus according to claim 6, wherein:

said arm means are mounted in a hinge for movement into and out of engagement with the tube blank trailing end portion.

8. Apparatus according to claim 6, wherein:

said power transmission means consists of a hydraulic cylinder connected to said arm means.

9. Apparatus according to claim 5, which includes:

sensing means for sensing the passage of the tube blank trailing end portion and transmitting a signal which causes the pre-reduction means to be pressed against the tube blank trailing end portion.

10. Apparatus according to claim 5, wherein:

said pre-reduction means is fixed to a rolling stand.

11. Apparatus according to claim 5, wherein said pre-reduction means includes:

forming means for engaging the trailing end portion of the tube blank to reduce the outside diameter of the trailing end portion prior to the trailing end portion into said rolling mill;

actuator means for positioning said forming means in engagement with the trailing end portion prior to introduction of the trailing end portion into said rolling mill;

sensor means for detecting the presence of the trailing end portion prior to introduction into said rolling mill as the tube blank is continuously fed into said rolling mill; and a controller connected to said sensor means and said actuator means, said controller being responsive to said sensor means upon detection of the tube blank trailing end portion to actuate said actuator means to position said forming means in engagement with the trailing end portion.

12. Apparatus according to claim 11, wherein:

said sensor means includes a proximity detector for identifying the tube blank trailing end portion prior to introduction of the trailing end portion into said forming means; and said sensor means including a microprocessor for initiating operation of said actuation means at a prescribed time as determined by the rate of feed of the tube blank to said forming means to move said forming means into engagement with the trailing end portion.

13. Pre-reduction roll forming apparatus comprising:

a frame;

a pair of arms;

pivot means for connecting said pair of arms in opposed relation on said frame to move said pair of arms toward and away from each other;

forming means mounted on said pair of arms for engaging a tube blank to reduce the outside diameter thereof as the tube blank is advanced in a preselected feed path relative to said frame;

actuator means mounted on said frame and connected to said pair of arms for selectively moving said pair of arms to move said forming means between a first position removed from engagement with the tube blank and a second position in engagement with the tube blank;

control means connected to said actuator means for sensing the presence of the tube blank in the feed path and actuating said actuator means at a preselected time interval for engagement of said forming means with the tube blank;

a rolling mill positioned in the feed path of the tube blank after said forming means; and said rolling mill being a skew rolling mill.

14. Pre-reduction roll forming apparatus according to claim 13, which includes:

said rolling mill including rolls positioned relative to the feed path to receive the tube blank after the tube blank passes said forming means; and said control means being operable to actuate said actuator means to move said forming means into engagement with a trailing end portion of the tube blank to reduce the outside diameter thereof prior to introduction of the trailing end portion into said rolling mill.

15. Pre-reduction roll forming apparatus according to claim 13, wherein:

said forming means includes a plurality of forming rolls;

means for mounting said forming rolls on said pair of arms in a symmetrical configuration around the feed path of the tube blank, and said pivot means including a pivotal axis positioned in underlying relation with the tube blank feed path.

16. Pre-reduction roll forming apparatus according to claim 15, which includes:

a pair of pre-reduction rolls mounted on each arm member such that when said pair of arms are in said second position relative to the tube blank said pre-reduction rolls compressingly engage the tube blank to reduce the outside diameter of a trailing end portion of the tube blank as the remaining portion of the tube blank continues to advance along the feed path.

17. Pre-reduction roll forming apparatus according to claim 13, wherein:

said control means includes a proximity sensor for detecting the presence of a trailing end portion of the tube blank as the tube blank advances in the feed path;

said proximity sensor being positioned to detect the presence of the tube blank trailing end portion a preselected distance in advance of said forming means; and means for connecting said proximity sensor to said actuator means to initiate movement of said pair of arms as determined by the rate of feed of the tube blank for engagement of said forming means in compressive relation with the trailing end portion as the tube blank advances in the feed path.

18. Pre-reduction roll forming apparatus according to claim 13, which includes:

a rolling mill; and means for positioning said frame on said rolling mill to permit a reduction in the outside diameter of a trailing end portion of the tube blank prior to introduction of the tube blank into said rolling mill.

* * * * *

UNITED STATES PATENT AND TRADEMARK OFFICE

CERTIFICATE OF CORRECTION

PATENT NO. : 5,125,251

DATED : June 30, 1992

INVENTOR(S) : Gustav-Adolf PETTERSSON, Ernst ZIMMERT, Bengt JAGAEUS and Aake SANDBERG It is certified that error appears in the above-indentified patent and that said Letters Patent is hereby corrected as shown below:

On the title page:Item [63] , insert the following Continuing Application Data:

--Related International Application Data
Continuation-in-part of International Application No. PCT/DE89/00407, filed on June 16, 1989.--

Signed and Sealed this

Fifteenth Day of October, 1996

*Attest:*

*Attesting Officer*

BRUCE LEHMAN

*Commissioner of Patents and Trademarks*